US011661310B2

(12) United States Patent
Salmikuukka

(10) Patent No.: US 11,661,310 B2
(45) Date of Patent: May 30, 2023

(54) CONTENT INFORMATION OF FLOOR OF ELEVATOR

(71) Applicant: KONE Corporation, Helsinki (FI)

(72) Inventor: Jukka Salmikuukka, Espoo (FI)

(73) Assignee: KONE CORPORATION, Helsinki (FI)

( * ) Notice: Subject to any disclaimer, the term of this patent is extended or adjusted under 35 U.S.C. 154(b) by 1427 days.

(21) Appl. No.: 15/842,244

(22) Filed: Dec. 14, 2017

(65) Prior Publication Data

US 2018/0105390 A1 Apr. 19, 2018

Related U.S. Application Data

(63) Continuation of application No. PCT/FI2015/050474, filed on Jun. 26, 2015.

(51) Int. Cl.

| | |
|---|---|
| ***B66B 3/00*** | (2006.01) |
| ***B66B 1/34*** | (2006.01) |
| ***B66B 19/00*** | (2006.01) |

(52) U.S. Cl.

CPC ..... *B66B 3/008* (2013.01); *B66B 1/34* (2013.01); *B66B 3/006* (2013.01); *B66B 19/007* (2013.01)

(58) Field of Classification Search

CPC ..... B66B 1/468; B66B 3/002; B66B 1/3415; B66B 3/008; B66B 2201/402; B66B 1/34;

(Continued)

(56) References Cited

U.S. PATENT DOCUMENTS 6,206,142 B1 * 3/2001 Meacham ..... B66B 3/00 187/392
6,341,668 B1 * 1/2002 Fayette ..... B66B 3/00 187/247

(Continued)

FOREIGN PATENT DOCUMENTS

EP 0 403 232 A2 12/1990
EP 1 291 311 A1 3/2003

(Continued)

OTHER PUBLICATIONS

International Search Report (PCT/ISA/210) issued in PCT/FI2015/050474, dated Oct. 27, 2015.

(Continued)

*Primary Examiner* — Marlon T Fletcher

(74) *Attorney, Agent, or Firm* — Birch, Stewart, Kolasch & Birch, LLP

(57) ABSTRACT

Floor content information of an elevator is described. According to an embodiment, a device is disclosed, comprising: a processor; a storage comprising a set of instructions; wherein the set of instructions cause the processor to: Receive a destination floor of the elevator; Receive information describing content of the destination floor, wherein the content identifies the content located within the destination floor; Based on the destination floor and the information describing the content of the destination floor, display a data notification to at least one user using the elevator travelling to the destination floor. According to other embodiments, an elevator, a method and a computer program product is described along with the features of the device.

17 Claims, 3 Drawing Sheets

102 - Display

(58) Field of Classification Search
CPC ... B66B 3/00; H04N 5/232939; Y04S 40/124; Y04S 50/14; Y04S 10/40; A61G 2203/20
See application file for complete search history.

(56) References Cited

U.S. PATENT DOCUMENTS

| | | | | |
|---|---|---|---|---|
| 2002/0036122 | A1 | 3/2002 | Fayette et al. | |
| 2003/0167464 | A1 | 9/2003 | Meyer | |
| 2018/0099839 | A1* | 4/2018 | Williams | B66B 1/468 |
| 2018/0099840 | A1* | 4/2018 | Armistead | B66B 3/008 |
| 2018/0101873 | A1* | 4/2018 | Cai | G06Q 30/0251 |
| 2018/0105390 | A1* | 4/2018 | Salmikuukka | B66B 3/008 |
| 2018/0162690 | A1* | 6/2018 | Hsu | B66B 3/00 |

FOREIGN PATENT DOCUMENTS

| | | | | |
|---|---|---|---|---|
| EP | 1 870 367 | A1 | 12/2007 | |
| FR | 2744551 | A1 * | 8/1997 | G06F 3/0485 |
| WO | WO 2013/038060 | A1 | 3/2013 | |

OTHER PUBLICATIONS

Written Opinion of the International Searching Authority (PCT/ISA/237) issued in PCT/FI2015/050474, dated Oct. 27, 2015.

* cited by examiner

102 - Display

CONTENT INFORMATION OF FLOOR OF ELEVATOR

BACKGROUND

Information systems for elevators have not been widely spread. Typically, mostly floor information is displayed to the user of the elevator. Especially inside the elevator, the user sees merely the floor number at the display unit, such as a number of the current floor of the elevator. Additionally, the elevator may contain specific information attached inside the elevator. For example, different kinds of textual or graphical notifications or labels may be manually and mechanically inserted inside the elevator. They are typically temporary so that a certain notification or information is manually and mechanically removed, or replaced, after a period of time.

SUMMARY

An object of an embodiment may be to provide floor content information of an elevator. The object may be achieved by the features of the independent claims. Further embodiments are discussed in the dependent claims.

Floor content information of an elevator is described. According to an embodiment, a device is disclosed, comprising: a processor; a storage comprising a set of instructions; wherein the set of instructions cause the processor to: Receive a destination floor of the elevator; Receive information describing content of the destination floor, wherein the content identifies the content located within the destination floor; Based on the destination floor and the information describing the content of the destination floor, display a data notification to at least one user using the elevator travelling to the destination floor.

According to other embodiments, an elevator, a method and a computer program product is described along with the features of the device.

At least one of the afore-mentioned implementation examples offers one or more solutions to the problems and disadvantages of the known prior art. Other technological benefits of the present invention become evident to a person skilled in the art from the following description and the claims. The numerous examples of implementing the present invention achieve only a part of the presented advantages. None of the advantages is critical to the examples of implementation. Any required embodiment can technically be combined with any other required embodiment. The examples represent only a few advantageous embodiments and they do not limit the idea of the invention that can be implemented even in other manners within the framework of the claims presented further below.

BRIEF DESCRIPTION OF THE DRAWINGS

The attached figures illustrate examples of embodiments of the present invention, and together with the above general description and the detailed current embodiments help explain, by way of examples, the principles of the invention.

DETAILED DESCRIPTION

Figure 1:
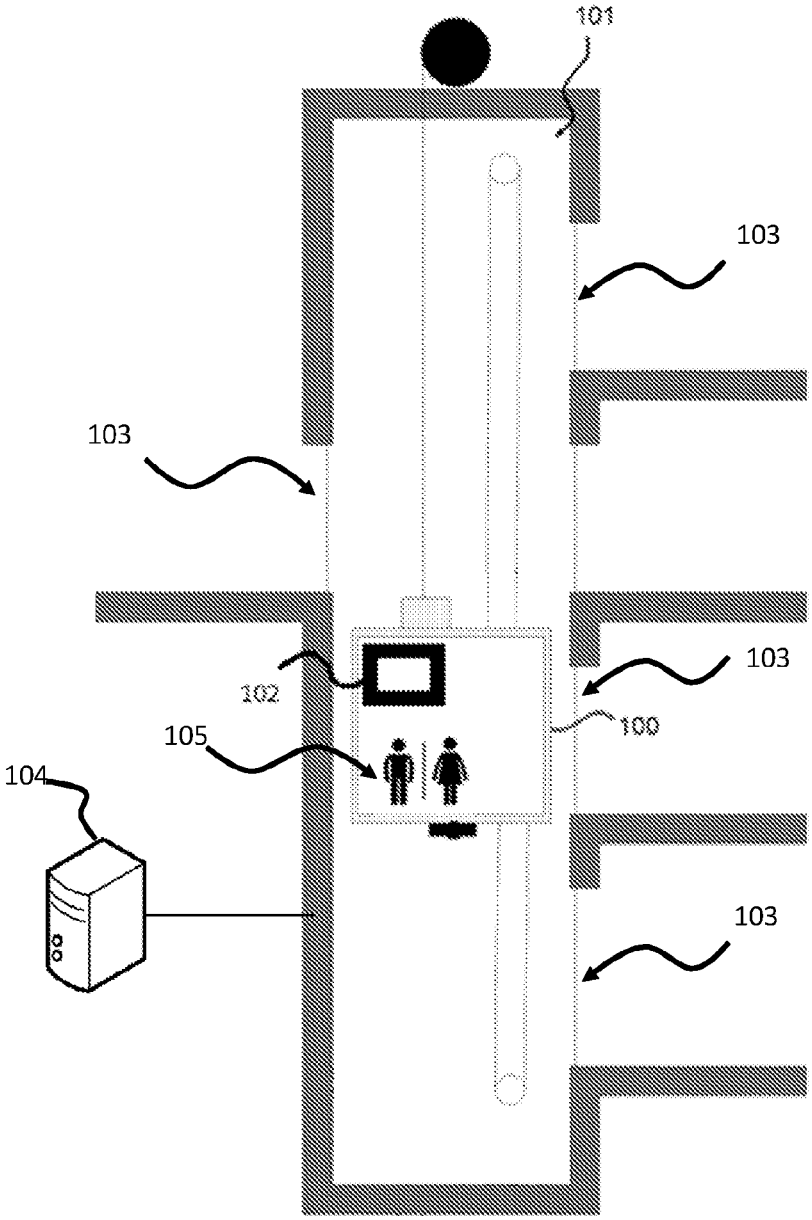
FIG. 1 is a schematic cross section of an elevator shaft having an elevator with a display in accordance with an embodiment.

In the embodiment FIG. 1, an elevator 100 is illustrated. The elevator 100 runs within an elevator shaft 101. Different floors 103 are also illustrated in FIG. 1. Each floor 103 of the building has different kind of content, for example, depending on the building type, the floor content may be a parking hall, office spaces, apartment blocks, shops, etc. The floor content may be any kind of information describing what the floor has and/or what the floor is. The floor content describes more details of the floor than, for example, illustrating a number or an abbreviation of the floor. A server 104 is connected to the display 102. The display 102 may be inside the elevator. According to another embodiment, the display 102 may be positioned in a lobby of the elevator floor 103. At least one user 105 of the elevator 100 is shown in the elevator 100 in FIG. 1. An embodiment of FIG. 1 provides a floor 103 content based data notification to a user 105 of the elevator 100. The displayed data notifications may be selected based on the use and type of the floor 103 or building, for example a shopping center, hotel, etc. Furthermore, it may maintain and administer associated statistics of the floor content data notifications.

An embodiment of FIG. 1 includes a server 104 which is loaded with a set of instructions. The set of instructions may be selected based on a desired criterion or several criteria. The set of instructions are configured to present at the display 102 the floor content data notifications to the user 105. The floor content data notifications may be based on various criteria, for example at least a portion of the content of the destination floor 103 where the elevator 100 is set to go from the origin floor 103. According to an embodiment, the floor content data notifications may be based on an elevator ride from an origin floor to a target floor, or be based on personalized information of the user 105 such as gender, age, etc. The personalized information of the user 105 may be obtained from an access control system or other control system, etc.

Data notifications are transmitted to a display 102 of the elevator 100 from the server 104. According to an embodiment, media data content is transmitted to a media display that is situated in the elevator. This may include pictures, sound, audio, video.

According to an embodiment, analysis of the activities of the user 105 of the elevator 100, and consequently collection of data of the analysis, may enable use of the data notifications within the elevator 100 or in connection with the elevator 100. An embodiment may better focus the elevator's 100 data notifications for certain users, even in terms of a campaign of the data notifications. An embodiment may design the content of the data notifications, for example to have more user personalized data notifications. An embodiment may increase the probability of meeting the target of data notification success plans. An embodiment may enhance recordability and measurability of the executed data notifications.

The server 104 may be an elevator specific, a building specific, and/or a cloud service. The elevator specific server controls a single elevator, for example as illustrated in the embodiment of FIG. 1. A building specific server may control several elevators, or there may be several connected servers controlling the building. A cloud service may control a single elevator 100, individual elevators 100 of the building, even up to several buildings with elevators 100. An embodiment may be extended to multiple displays 102, for example to an entire elevator group, a whole building, or several buildings. Consequently, one or more server 104 may control one or more displays 102.

An embodiment describes a report of the data notifications. According to an embodiment, an automatic report may be obtained with respect to the data notifications. The report may be configured to describe how the data notifications have reached the users 105. Data notifications may be focused on a certain user 105 based on the received data information. Rather than having standing fixed notifications on the walls of the elevator, dynamic data notifications are being displayed, possibly with respect to the desired users 105. According to an embodiment, a data notification campaign may be established. The server may be configured to create new data notifications and campaigns at least semi-automatically based on the collected and statistical data of the performed data notifications. For example, the server 104 may alter the data notifications based on the received information relating to the user 105.

According to an embodiment, a number of users 105 of the elevator 100 can be detected. For example, the number of users 105 may be calculated in real time. This information may be used in executing the data notifications. Thus, the data notification may be partly based on the number of users 105 of the elevator 100. According to an embodiment, an access system which is connected to the server 104 detects the number of users 105. The access system sends the number of users 105 to the server 104. Consequently, the server 104 may render the data notifications based on the received number of users 105.

According to an embodiment, for example optionally with respect to other embodiments, access information of the user 105 may be collected. Personal details of the user 105 may be detected based on an access identification system of the user 105, such as a personal access key. For example, gender, age, family status, etc may be collected. By an embodiment, personal details may be conveyed from an external system having such data. The access system may contain personal information of the user 105. The access system may convey this personal information to the server 104, to be processed for rendering the data notifications at the display 102.

According to an embodiment, data indicating a destination floor 103 of the path of the elevator 100 is collected. Thus, elevator data may be collected in real-time. Elevator data may indicate an origin floor 103 such as the current floor where the elevator 100 is. The data may indicate a target floor 103, such as a destination where the elevator 100 is supposed to go, for example as a user 105 presses a certain floor button. In addition to and/or in combination with the above, the elevator data may comprise floor level content information of the departure and the destination floors, for example content of what the destination floor 103 is, such as the destination floor 103 being a metro station. As another example, the content may indicate what the destination floor 103 contains, such as children's clothing of a department store. The content data of the floor 103 may contain specific units, locations, places, functionalities relating to a certain floor 103.

According to an embodiment, each data notification may have a defined target hit or hits in terms of, for example, a number of presentations at the display 102. However, there may be other factors as well. The access data of the user 105, when it is available, may be used for defining the target number of presentations. A data notification having a desired context may be used in an embodiment. For example, the context may be a way to a women's clothing department. Based on the context, it can be profiled to what kinds of persons, having personal interests, the data notification has been displayed at the display 102.

According to an embodiment, the following data information may be enclosed in the process of rendering the data notifications: identification data of the displayed data notifications, time of the data notifications, date of the data notifications, the number of users relating to the data notifications, and information relating to the elevator path, such as the target floor content information, for example a floor of women's clothing. According to an embodiment, in addition to or instead of the above, the following may be included with respect to any embodiments: user access control information. Because the user access control information may be subject to privacy, it may be profiling information instead of personal identifying information.

According to an embodiment, the server 104 may be configured to establish a log or a register. For example, data which is applied in the embodiments is automatically generated in the log. The log may contain all data, for example as discussed in the embodiments. As another embodiment, the log may contain certain data, while other data is omitted; for example media data notifications, elevator travel data, floor content data, as well as the access data, and their synchronizing data.

An embodiment may enable the calculation of how many users 105 have been displayed the data notification at the display 102. This may be based on the detected number of users 105 and/or the number of presentations of the data notification. Furthermore, the context of the data notification may be determined, for example if the data notification has been illustrated on a way to the food department of the building where the elevator 100 is situated. An embodiment may in real-time control the selection of content of the data notifications automatically so that those data notifications which have not yet reached the target number of hits, for example "reached eyeballs", may be further displayed. However, when the presentation of the data notification reaches the target amount, it can be stopped and the server 104 generates an alert notification.

An embodiment may configure the server 104 to insert a data notification to a buffer or a queue which is maintained at the server 104. When a number of presentations of a certain data notification reaches a predetermined threshold, the server 104 may remove it from the playlist and a new data notification may, optionally automatically, replace the previous one. The server 104 may store the previous data notification and insert it at the bottom of the playlist. Consequently, the server 104 may operate a playlist of data notifications.

According to an embodiment, new data notifications and campaigns of the data notifications may be designed on the basis of collected data of previous presentations. They may be performed automatically by the server 104. In addition or alternatively to the above, an administrator of the server 104 may design new data notifications and campaigns. For example, the designing criteria may be as follows: reaching the target or hit as soon as possible, reaching the target or hit as quickly as possible and with the fewest number of presentations on the screen, reaching the maximal target or hit within a predetermined time, within a predetermined number of displays, and within a predetermined geographical area.

Figure 2:
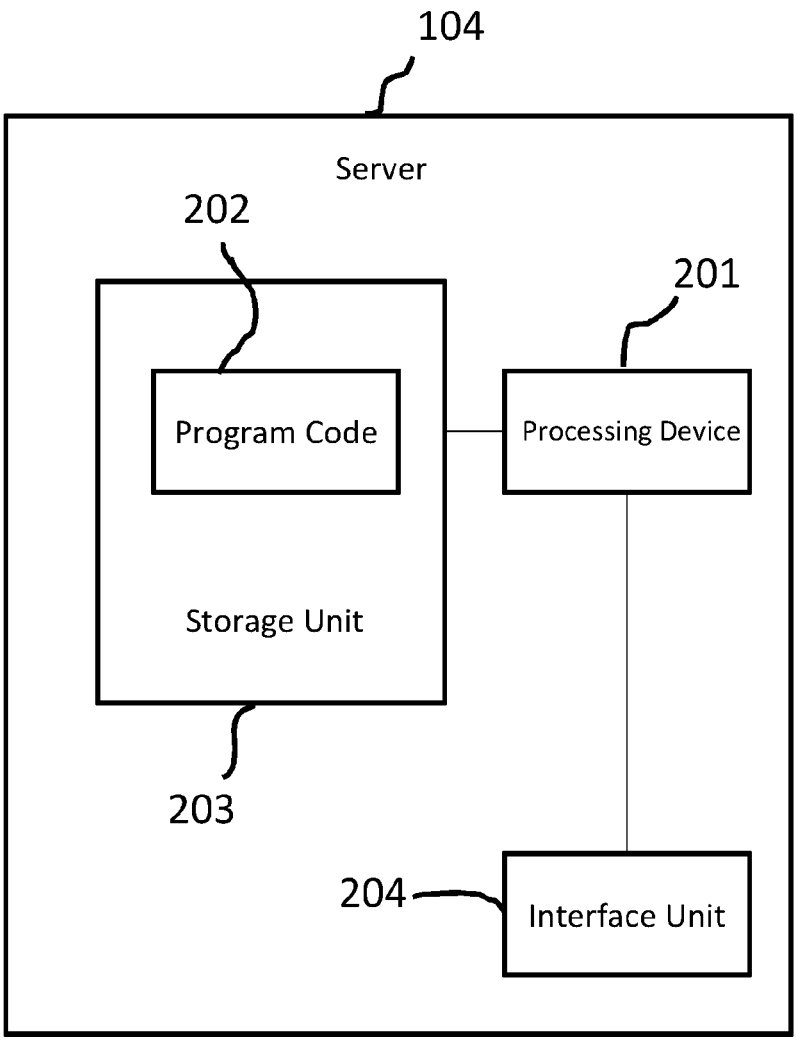
FIG. 2 is a schematic diagram of a server according to an embodiment.

A schematic diagram of the server 104 according to an embodiment is shown in FIG. 2. The server 104 can be a computing device in the elevator shaft 101 or in the elevator 100. The server 104 may include a processing device 201 such as a microprocessor or Application Specific Integrated Circuit, ASIC, a storage unit 203 and a communication interfacing unit 204. The storage unit 203 may be any data storage device that can store a program code 202, accessed and executed by the processing means 201. Examples of the storage unit 203 include but are not limited to read-only memory, ROM, flash memory, random-access memory, RAM, CD-ROM/DVD-ROM, magnetic tape, hard disk and optical data storage device. The communication interfacing unit 204 may be a transceiver and is used to transmit and receive signals, for example messages or packets, according to processing results of the processing means 201. The functionality described herein can be performed, at least in part, by one or more hardware logic components. According to an embodiment, the server 104 is configured by the program code 202 when executed by the processing device 201 to execute the embodiments of the operations and functionality described.

Figure 3:
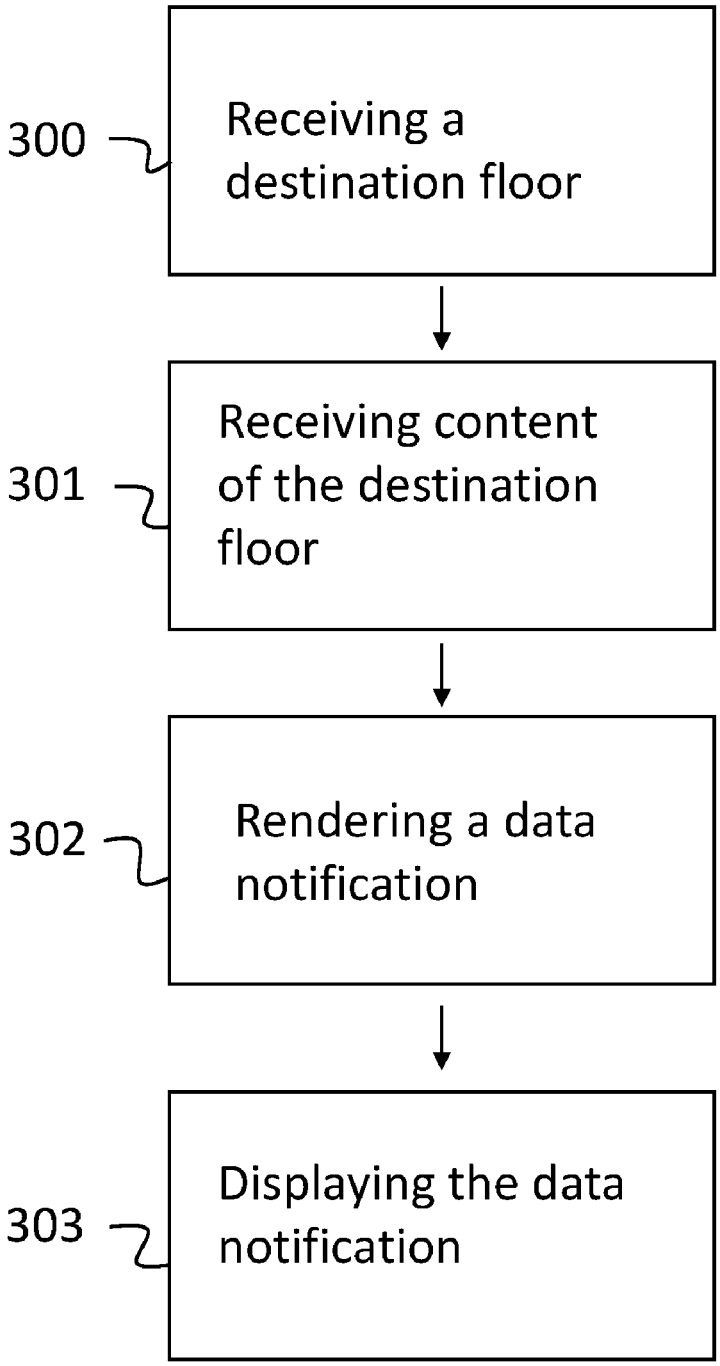
FIG. 3 is a schematic flow chart of displaying content information of a floor of an elevator in accordance with an embodiment.

Referring to FIG. 3, the process is utilized in the server 104 shown in FIG. 2 for controlling the operation of the elevator 100. The process of FIG. 3 may be compiled into the program code 202. According to an embodiment, the process may include the following steps:

Step 300: destination floor;

step 301: content of the floor;

step 302: render data notification; and step 303: display data notification.

According to the embodiment of the process, there is being received a destination floor of an elevator in step 300. According to an embodiment, the user 105 provides the elevator 100 with the destination floor information. The destination floor information is transferred to the server 104. According to step 301, there is being received information describing content of the destination floor. The content identifies the content located within the destination floor. According to an embodiment, the server 104 receives or stores a plurality of contents of the destination floor, identifying the content located within the destination floor, for example that floor 7 contains a first and a second clothing store, floor 0 is a parking hall, floor 10 contains apartments with names, etc. In step 302, there is being rendered the data notification. According to an embodiment, the server 104 processes the data notification based on the destination floor and the information describing the content of the destination floor. For example, if the user 105 has pressed floor 7 and the second clothing store has given a notification into the server 104, the server renders a data notification based on the second clothing store which is located in floor 7. In step 303, there is being displayed the data notification to at least one user using the elevator travelling to the destination floor.

For a person skilled in the art, it is obvious that numerous modifications and variations can be made to the equipment and the method. Other embodiments and exemplary implementations become evident to a person skilled in the art on the basis of the specification and practice related to the equipment and method described. The purpose is that the specification and the examples be regarded only as exemplary, so that the following patent claims and their equivalents show the actual scope of protection.

The invention claimed is:

1. A device, comprising:

a processor; and a storage comprising a set of instructions, wherein the set of instructions cause the processor to:

receive a destination floor of the elevator;

receive information describing a content of the destination floor, wherein the content identifies elements that the destination floor contains; and based on the destination floor and the information describing the content of the destination floor, display a data notification to at least one user using the elevator travelling to the destination floor, wherein the data notification is personalized to each of the at least one user based on access information of the at least one user collected via a personal access key of the at least one user.

2. The device of claim 1, wherein the set of instructions causes the processor further to render the data notification based on the located content within the destination floor.

3. The device of claim 1, including a detector configured to detect a number of users of the elevator, wherein the set of instructions causes the processor further to display the data notification also based on the detected number of users.

4. The device of claim 1, wherein the number of users is received from an access system.

5. The device of claim 1, wherein the set of instructions causes the processor further to receive a path of the elevator, wherein the path comprises an origin floor of the elevator and the destination floor, wherein the set of instructions causes the processor further to display the data notification also based on the path.

6. The device of claim 1, including a counter configured to calculate a number of presentations of the data notification.

7. The device of claim 6, wherein the data notification is not displayed when a threshold of the counter has been exceeded.

8. The device of claim 1, including a buffer configured to store several data notifications, wherein the data notifications are queued.

9. The device of claim 1, wherein the data notification includes a target number of presentations.

10. The device of claim 1, wherein the data notification includes a target, wherein the target is based on the access data.

11. The device of claim 1, wherein the data notification includes a target, wherein the target is based on the content.

12. The device of claim 1, wherein the data notification includes an identification and a time stamp.

13. An elevator comprising the device of claim 1.

14. The device of claim 1, wherein the data notification is differently displayed depending on a type of the destination floor among a plurality of types.

15. A method, comprising the steps of:

receiving a destination floor of an elevator;

receiving information describing a content of the destination floor, wherein the content identifies elements that the destination floor contains; and based on the destination floor and the information describing the content of the destination floor, displaying a data notification to at least one user using the elevator travelling to the destination floor, wherein the data notification is personalized to each of the at least one user based on access information of the at least one user collected via a personal access key of the at least one user.

16. A computer program product, comprising programmable means embodied on a non-transitory computer readable medium and configured to cause a computer to perform the steps of the method of claim 15.

17. The method of claim 15, wherein the data notification is differently displayed depending on a type of the designation floor among a plurality of types.

* * * * *